United States Patent [19]

Kermabon

[11] Patent Number: 4,466,484

[45] Date of Patent: Aug. 21, 1984

[54] ELECTRICAL DEVICE FOR PROMOTING OIL RECOVERY

[75] Inventor: André J. Kermabon, Marseilles, France

[73] Assignee: Syminex (Societe Anonyme), France

[21] Appl. No.: 383,166

[22] Filed: May 28, 1982

[30] Foreign Application Priority Data

Jun. 5, 1981 [FR] France ..... 81 11349

[51] Int. Cl.[3] ..... E21B 43/24

[52] U.S. Cl. ..... 166/60; 166/65 R; 166/248

[58] Field of Search ..... 166/248, 65 R, 60, 302; 219/277, 278; 204/180 R, 299 R

[56] References Cited

U.S. PATENT DOCUMENTS

| | | | |
|---|---|---|---|
| 2,118,669 | 5/1938 | Grebe | 204/180 R |
| 2,217,857 | 10/1940 | Byck | 166/65 R |
| 2,748,868 | 6/1956 | Carpenter | 219/278 |
| 2,799,641 | 7/1957 | Bell | 166/248 |
| 2,982,354 | 5/1961 | Green | 166/60 |
| 3,211,220 | 10/1965 | Sarapun | 166/65 R |
| 3,417,823 | 12/1968 | Fario | 166/248 |
| 3,507,330 | 4/1970 | Gill | 166/248 |
| 3,547,192 | 12/1970 | Claridge | 166/302 |
| 3,620,300 | 11/1971 | Crowson | 166/248 |
| 3,862,662 | 1/1975 | Kern | 166/248 |
| 4,046,194 | 9/1977 | Cloud | 166/248 |
| 4,228,854 | 10/1980 | Sacuta | 166/248 |
| 4,382,469 | 5/1983 | Bell et al. | 166/248 |

FOREIGN PATENT DOCUMENTS

| | | | |
|---|---|---|---|
| 460561 | 11/1945 | Belgium . | |
| 685156 | 4/1964 | Canada | 166/65 R |
| 1268588 | 6/1961 | France . | |

OTHER PUBLICATIONS

Anbah, "Application of Electrokenetic Phonomena in Civil Engineering and Petroleum Engineering," Feb. 1965.

*Primary Examiner*—Stephen J. Novosad
*Assistant Examiner*—Hoang C. Dang

[57] ABSTRACT

The present invention relates to a method and device for promoting oil recovery.

The device according to the invention for promoting the recovery of oil contained in a reservoir formation from a well equipped with a casing, comprises an anode which is placed at the bottom of the well, below said reservoir formation, in an electro-conductive liquid, and which is connected to the positive terminal of a direct or pulsed source of unidirectional voltage. Said casing is connected to the negative terminal of said source. The method consists in applying a unidirectional voltage for periods varying between several days and several months and alternating with OFF-period (when no voltage is applied).

3 Claims, 5 Drawing Figures

ELECTRICAL DEVICE FOR PROMOTING OIL RECOVERY

The present invention relates to a method and electrical device for promoting oil recovery.

Many processes and devices using electric energy have been proposed and tested with a view to increasing the mobility of hydrocarbons in their field and to improving the tertiary recovery of hydrocarbons.

A first category of methods uses the heat obtained by Joule effect. These methods require a high electrical power to sufficiently heat the oil deposit and they use alternating current.

The heat is used for example to carbonize bituminous schists according to the methods described in U.S. Pat. Nos. 3,106,244, 3,137,347, 3,428,125 (H. PARKER).

Heat is also used to liquefy paraffins, asphalts, or bitumen or to reduce viscosity, in U.S. Pat. No. 1,372,743 (B. GARDNER), U.S. Pat. No. 3,848,671 (L. KERN) and U.S. Pat. No. 3,149,672 (J. ORKISZEWSKI et al.).

And heat due to the passage of electric current has also been used to produce steam in situ in U.S. Pat. Nos. 3,507,330, 3,547,193, 3,605,888, 3,614,986 (W. G. GILL et al.), U.S. Pat. No. 3,620,300 (F. CROWSON) and U.S. Pat. No. 3,547,192 (E. CLARIDGE).

A second category of methods uss electrolysis and the resulting gases to pressurize the deposit or to combine these gases to the hydrocarbons. Such methods are described in U.S. Pat. No. 1,784,214 (P. WORKMAN), U.S. Pat. No. 3,103,975 (A. W. HAUSON) U.S. Pat. Nos. 3,724,543 and 3,782,465 (C. W. BELL et al.), U.S. Pat. No. 4,037,655 (N. CARPENTIER).

A third category of methods uses the action of a unidirectional electric current on a liquid contained in a porous medium similar to capillary tubes for moving the liquid by a phenomenon known as electro-osmosis.

The phenomenon of electro-osmosis is used for example to prevent the bottom of the well from being invaded by the layer of saline water (Coning effect).

U.S. Pat. No. 3,202,215 (A. STANOWIS) describes a method consisting in using electro-osmosis to maintain a volume of pure water at the bottom of a well to keep saline water out.

Other patents describe methods permitting to move the oil by electro-osmosis.

French Pat. No. 1 268 588 (Institut francais du PACU/e/ trole) describes a method which consists in applying between two electrodes situated in two points of an oil formation, a high potential difference with a specific direction, for example a potential difference varying between 1000 and 100,000 volts.

U.S. Pat. No. 2,799,641 (T. G. BELL) describes a method for promoting oil recovery, wherein a potential difference is applied between a first electrode of positive polarity situated in the oil formation at a distance from the producing well and a second electrode of negative polarity situated in the producing well and in direct contact with the reservoir formation.

The direct current is at least 70 volts and the strength of the current about 10 amperes. The oil is moved towards the cathode. The current is interrupted periodically with a frequency of 6 to 30 cycles per minute. It is also possible to use pulses due to discharges from a capacitor energized at a voltage of between 1000 and 3000 volts. It is likewise possible to use an asymmetrical alternating current having a frequency of between 1 and 10 Hz.

U.S. Pat. No. 3,417,823 (S. R. FARIS) describes a method which consists in placing an anode and a cathode inside the same well and causing the water to move towards the cathode by electro-osmosis.

U.S. Pat. No. 3,642,066 (William G. GILL) describes a method to promote oil recovery consisting in placing a cathode inside a producing well and an anode in an auxiliary well in order to move the water away from the oil formation towards the anode, and the oil towards the cathode. A direct but pulsed potential difference is applied between anode and cathode. The electrodes penetrate into the reservoir formation.

U.S. Pat. Nos. 3,724,543 and 3,782,465 (Christy W. BELL and Charles H. TITUS) describe means whereby a small surface anode is placed inside a cavity situated in the middle of the formation and conductive water is injected all around said anode. A direct potential difference of several thousands of volts is set up between said anode and the casing of a producing well used as cathode. The heated water around the anode migrates towards the cathode, under the effect of pressure and of electro-osmosis, taking away the oil.

Said patents show that it is known to use a direct or pulsed unidirectional potential difference, to promote the migration of oil towards an electrode by an electro-osmotic effect in a porous medium, which may be completed by a heating and an electrolysis of the saline water contained in the formation.

It is the object of the present invention to propose a method for promoting oil recovery, consisting in using electric energy and in optimizing the results of the operation, i.e. the ratio of the extra oil which can be recovered to the electrical energy used.

Tests have been conducted in laboratories on samples of soil shaped as test cores.

Said cores of rocks were first washed and dried, and saturated in saline water. Then oil was circulated through until irreducible water saturation. The oil impregnating the rock, on the other hand, was known.

A unidirectional potential difference was applied between the two longitudinal ends of the core for preset periods, and the extra quantity of oil recovered from the sample either during the application of the current or after, was measured, then a study was made of how the extra quantity of oil recovered from the test core can vary in relation to parameters such as the electrical field, the strength of the current, and the duration of application of said current and of the rest periods alternating with the energizing periods.

Such tests have confirmed that if oil is only recovered by hydraulic scavenging by creating a difference of pressure between the two ends of the test core, when no more oil is extracted, then only a small part of the oil initially impregnating the test core is recovered. (Recovery by hydraulic scavenging is of about 40 to 50% for most samples tested in laboratories, and generally about 15 to 20% for an oil formation).

When applying a unidirectional potential difference between the two ends of the sample for a certain period of time, and additional quantity of oil is recovered during a production induced simultaneously or consecutively to the application of the electric field.

The additional quantity of oil recovered is independent of the direction in which production is induced with respect to the direction of application of the electric field, this permitting to presume that the effect of the electric field is to stimulate the movability of oil which can afterwards be moved in any direction. The electric field would thus act, not really as a means to drive the oil towards either the cathode or the anode, but as a means to break certain bonds retaining the oil in the formation, such as for example capillary forces or superficial stresses, and once these bonds are broken, the oil should be more mobile.

Tests have been conducted on samples to determine how the energy balance could vary, i.e. the quantity of extra oil which could be recovered in relation to the period of application of a specific field, and therefore in relation to the electric energy consumed.

These tests have proved that the energy balance remains substantially stable for a specific period of application of a specific electric field, which period can vary from a few days to a few months, depending on the nature of the formation and on the value of the electric field. The stability of that energy balance means that the extra quantity of oil which can be recovered varies with the duration of application of the electric field and with the energy balance, that is to say that the ratio of the quantity of oil recovered to the electric energy consumed, remains substantially constant for periods of application of current not exceeding a maximum limit. On the contrary, for longer periods of application of the electric field, the balance decreases and, whatever the relative cost of oil and of electric energy, there is a threshold beyond which the economic balance becomes unfavorable.

These tests show that it is therefore important for each oil formation to determine beforehand the maximum duration of application of the electric field, in order to prevent further consumptions of energy for results which are less than the profit derived therefrom, and the optimum period for which the balance is best.

It was obvious to consider that, after applying an electric field for a first period after which the extra quantity of oil recovered had become less than an economic threshold, this meant that all the oil which could be recovered by this method had been recovered, and that there was no need to repeat the operation, and this is exactly what has been done in the electric methods used up to now.

But the tests conducted on samples have shown this unexpected result whereby, by re-applying an electric field after an interruption of a few days to a few months, depending on the nature of the soils, another recovery of oil is obtained with an economic balance which will justify another cycle of application of the electric field.

It is thus possible to repeat cycles of application of a unidirectional electric field, of predetermined durations, which can vary between a few days and a few months, depending on the nature of the soils, which periods of electrically-induced draining alternate with OFF-periods when no electric field is applied and which can also vary between a few days and a few months, depending on the nature of the soils.

The phenomenon remains difficult to explain.

It can be compared to a cycle of polarizations and depolarizations.

The tests carried out on samples have shown that the additional quantity of oil recovered is considerable, even if the electric field is low, around 0.1 V/m. Obviously, higher or lower voltage gradients can be used. A low field applied for a long period gives an equivalent result to that given by a higher field, for example 1 V/m, applied for a shorter period.

The quantity of oil recovered is therefore substantially proportional to the electric energy supplied as long as the periods of application of the field remain below a pre-set duration.

It is therefore advantageous to use a low field in order to minimize losses due to heat produced by Joule effect.

An additional recovery of oil is not necessarily obtained precisely whilst the electrical field is applied. And it can continue after the potential difference has been stopped.

Tests have been conducted on samples by applying an alternating electric field whose frequency can vary between a few Hz and a few KHz.

These tests have shown that, in identical conditions, it was not possible with an alternating field to obtain as good an improvement of the oil recovery as that obtained by applying a direct or pulsed unidirectional electric field.

The present invention relates to methods for promoting the recovery of oil contained in a reservoir formation, from an oil well which extends as far as said formation.

The methods according to the invention are of the known type which consists in moving the oil by applying a direct or pulsed unidirectional potential difference between two electrodes, one of which at least is placed inside the well.

Tests conducted on samples have led to proposing a method of this type in which the unidirectional potential difference is applied for periods which can vary between a few days and a few months, which periods, alternating with OFF-periods (when no electric field is applied) which can vary between a few days and a few months, these cycles of alternated periods being repeated until the quantity of oil recovered falls to below a threshold of profitability.

Preferably, the periods of application of the unidirectional electric field are substantially equal in duration to the OFF-periods.

Advantageously, the lower electrode can be moved further away in order to obtain a better distribution of the electric field within the limits of usable power.

Advantageously, the vertical distance between the two electrodes, as well as the power injected therebetween, can be varied discontinuously, throughout the exploitation of the oil formation or during the application of the current. To this effect, the well can be deepened during preliminary equipment, taking into account the maximum depth of the lower electrode.

Advantageously, before each period during which a potential difference is applied, it is possible to inject into the reservoir formation, around the well, a volume of a highly resistive liquid, such as for example pure water.

The device according to the invention for recovering additional quantities of oil from a well equipped with a metallic casing extending at least as far as the roof of a reservoir formation, and traversing or not traversing same, comprises:

a very long electrode placed at the bottom of the well in an electro-conductive medium, which establishes a good electrical contact between the said electrode and the enveloping strata beneath the said reservoir formation;

a source of unidirectional voltage situated on the surface;

electro-conductive means permitting to connect the positive terminal of said source to said electrode, said electro-conductive means being isolated from said formation and from said casing;

means connecting the negative terminal of said source to the upper end of said casing;

and means permitting to apply the unidirectional voltage supplied by said source, in direct or pulsed manner, with a frequency reaching several pulses per minute, for predetermined periods of several days to several months, alternating with OFF-periods of several days to several months.

The vertical distance between the electrode and the lower end of the conductive casing is at least 40 meters.

The method and device according to the invention enable to recover an extra quantity of oil from a well by spending less in electric energy than the market value of the extra oil recovered. Compared with the known methods using electro-osmosis which apply a unidirectional D.C. until all the recoverable oil has been recovered, the method and device according to the invention enable to increase the total quantity of oil which can be recovered from a well by alternating periods during which a unidirectional voltage is applied with OFF-periods during which production can continue.

The method and device according to the invention enable to separate the electrically-powered phases from the production phases. They also enable to increase the production of a well by placing the two electrodes in the same well whilst influencing a large volume of the formation situated around said well.

One advantage of the method and device according to the invention, wherein the two electrodes are placed in the same well, resides in the fact that the distance between the electrodes can be chosen, which is not the case when the electrodes are placed in two different wells, and it also resides in the fact that said distance can be caused to vary.

The invention will be more readily understood on reading the following description with reference to the accompanying drawings in which.

Figure 1:
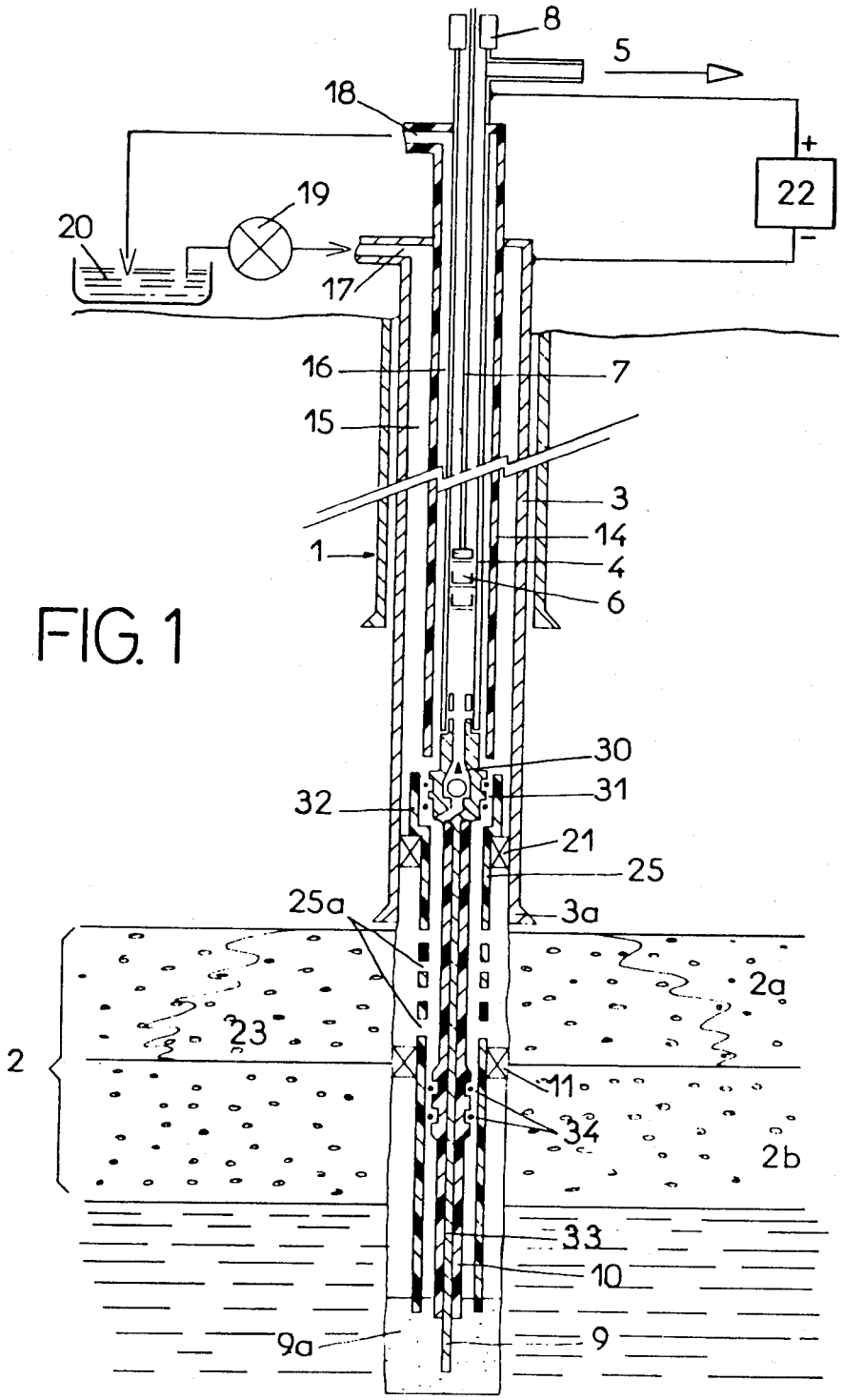
FIGS. 1 to 4 are vertical sections of an oil-producing well showing examples wherein the two electrodes are situated inside the same well.

FIG. 1 shows a well 1 drilled in the ground and which extends to a reservoir formation 2 containing oil and water. Said well 1 is, for example an oil-producing well. A sealing ring 11 divides the formation into two parts, an upper part 2*a* which corresponds to the oil-producing strata at a specific moment of the exploitation of the oil deposit and a lower part 2*b* which corresponds to strata containing water, normally saline water.

The well 1 is equipped with a metallic casing 3 ending into a shoe 3*a* situated at the top of the reservoir formation. The well in this example is an "open" type well. The well 1 is normally equipped with a production tubing 4 of which the upper end is connected with a production conduit 5. Said tubing 4 can comprise, as shown in FIG. 1, a pump with a piston 6 actuated by a rod 7 going through a stuffing-box 8.

In the illustrated example, the well comprises a suspended insulator column 25 of diameter smaller than that of the casing, the upper end of which is secured to a sealing ring 21 fixed to the casing. Said suspended insulator is made from an insulating material such as a glassfiber-reinforced resin. It traverses the formation 2 and comprises perforations 25*a* where it traverses the reservoir formation 2*a*.

The lower end of the production tubing is situated above the upper end of the supended insulator 25 and above the roof part of the reservoir formation.

The lower end of the production tubing is equipped with a non-return valve 30. A seal 31 is provided between the valve 30 and the upper end of the suspended insulator which comprises a widened portion 32.

The production bore 1 descends normally as far as the wall of the reservoir formation 2.

According to one embodiment of the method according to the invention, wherein two electrodes are placed inside the same well, it is advantageous to extend the bore to below the wall of the reservoir formation over a height which can vary between 20 and 500 meters depending on the case.

FIG. 1 shows a well which extends below the wall. The suspended insulator 25 is also extended to beneath the wall and the lower end of said insulator 25 is situated at a distance of about 10 metres above the bottom of the well.

An electrode 9 is placed at the bottom of the well inside an electro-conductive medium 9*a* which sets up a good electrical contact between said electrode 9 and the enveloping stratum. The electro-conductive medium may be saline water coming from the strata 2*b* of the formation. It can also be a nonelectrolyzable fluid containing conductive particles, or a metallic powder or a metallic alloy melting at low temperature, for example an alloy containing bismuth, lead, tin, cadmium and antimony.

Electrode 9 is very long, more than several meters, so that the density of the current leaving the electrode is reduced, this permitting to avoid a rise in temperature by Joule effect and to reduce corrosion.

In the embodiment illustrated in FIG. 1, the electrode 9 is placed at the lower end of a conductive rod 33 which is covered by an insulating sheath 10, insulating the rod over its entire length, except for the lower end acting as electrode. Preferably, the lower end is removable to allow easy replacement of the electrode if the latter wears out. An insulating liner 34 is placed between the insulating sheath 10 and the suspended insulator 25 on the same level or below the level of the ring 11.

The conductive rod 33 is secured to the lower end of valve 30 in such a way as to ensure an electric continuity, perforations being provided to allow the oil through. The production tubing 4 is used as a conductor to energize the electrode 9.

The upper end of the tubing 4 is connected to a terminal of a source 22 of direct or pulsed unidirectional voltage, and the upper end of the casing 3 is connected to the other terminal of the source 22. Preferably, the tubing is connected to the terminal of positive polarity and the electrode 9 is an anode.

With this choice of polarities, any phenomena of electrolytic corrosion which can occur on the anode, occur on the electrode secured to the tubing, which is easy to bring out of the well and to replace.

The casing 3 is normally a metallic conductive casing which is in electrical contact with the enveloping strata.

The production tubing 4 which is used as a conductor is insulated from the conductive casing by an insulator column 14 which defines, with the casing 3 and the tubing 4, two co-axial annular conduits 15 and 16, communicating by their lower end.

An insulating liquid, such as a mineral oil, can be circulated between the casing and the tubing in order to extract the calories from the heat of the tubing due to Joule effect. For example, the upper ends of the annular conduits 15 and 16 are respectively connected on pipes 17 and 18 which constitute the round flow of a circuit of insulating oil which is delivered by a pump 19 and returns to an oil tank 20.

The voltage delivered by the source 22 is a high unidirectional voltage, for example between 200 and several thousands volts.

The unidirectional voltage can be applied in direct or pulsed manner with frequencies of about several pulses per minute.

Unidirectional voltage is applied for a first period of long duration, from several days to several months, after that the application of electric current is stopped for a second period of long duration, i.e. several days to several months, for example the same duration as the preceding period. Recovery of the oil can continue during said second period.

New cycles of periods of application of current and of OFF-periods are then repeated until the production of petrol falls to under a threshold where the economic value of the oil recovered during a cycle is less than the cost of energy used throughout that cycle.

The disposition according to claim 1 enables to place two electrodes in the same well keeping a distance between said electrodes which may be great, for example several hundreds meters, so that the volume of the formation traversed by the lines of force of the electric field from the anode to the cathode is considerable.

The distance between the anode and the lower end of the casing acting as cathode is greater than 40 meters in order to influence an adequate volume of formation.

It will be noted that in the example, neither the anode nor the cathode are in the reservoir formation, on the contrary to the known methods wherein attempts are made to channel the oil towards one of the electrodes, generally toward the cathode which is placed in the formation. The electric field is used to mobilize the oil by modifying the capillary attraction forces, after what the oil travels towards the well in the normal way, for example by hydraulic scavenging.

FIG. 1 shows a volume of liquid with low conductive power which can be injected into the reservoir formation 2 around the well from the tubing 4 before applying the electric current. The liquid 23 is a highly-resistive liquid, such as for example pure water. Said liquid forms around the well, between the electrode and the lower end of the casing 3, a highly resistive annular zone, so that it enables a better penetration of the electrical current into the formation 2*a*, hence a possibility to improve recovery within a greater volume of formation around a single well.

Figure 2:
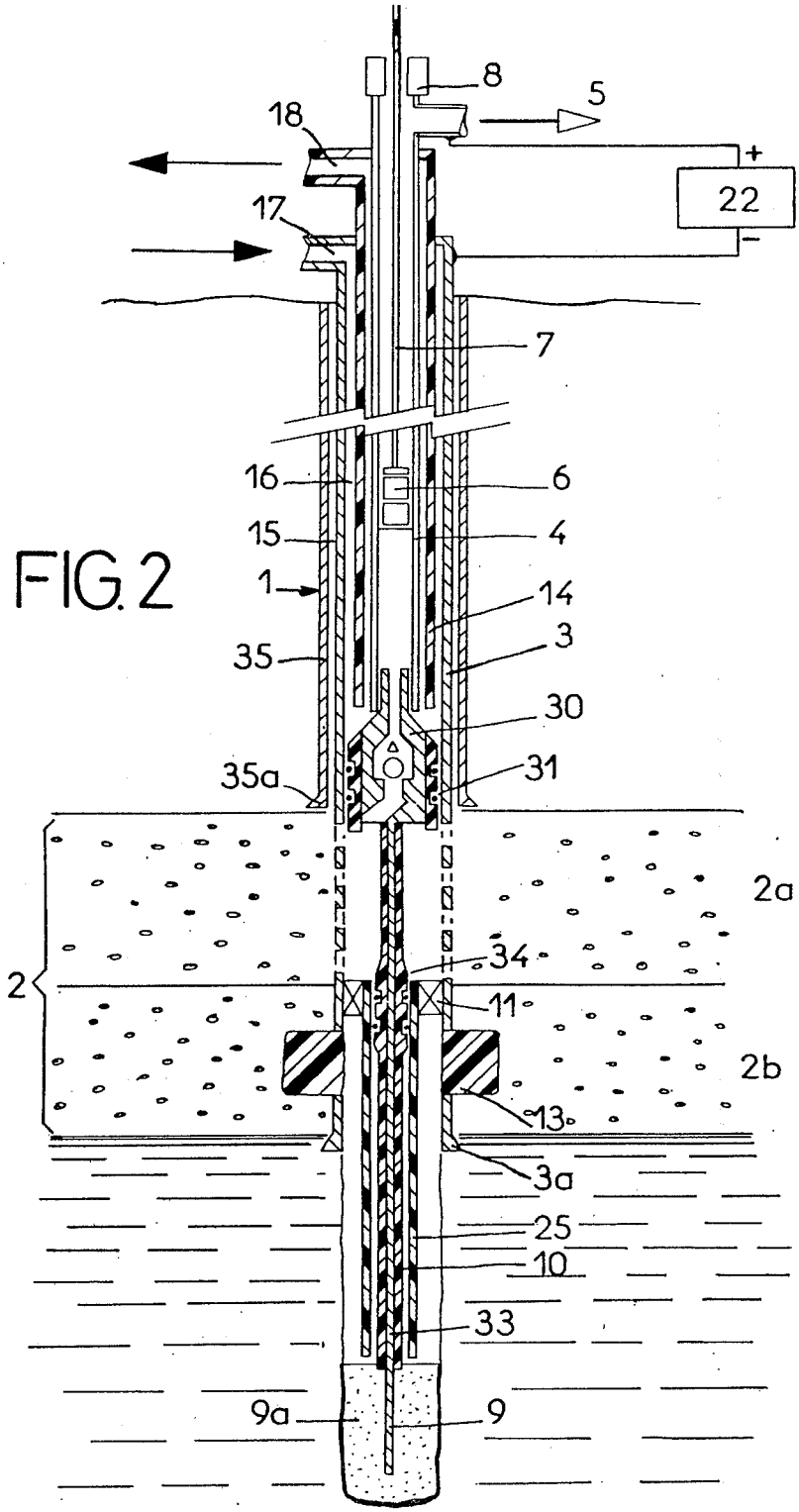

FIG. 2 shows an application of the invention to the case of a producing well 1 equipped with a perforated casing 3 traversing the reservoir formation 2 and of which the shoe 3*a* is situated on the wall of the formation. The homologuous parts have the same references in FIGS. 1 and 2.

In this example, the well has been deepened beyond the formation wall over a height varying between 20 and 500 meters and it is equipped with a suspended insulator 25 of which the upper end is secured to the ring 11 separating the producing strata 2*a* from the subjacent strata 2*b*.

An annular space is drilled in the conductive casing 3 in one part situated below the perforations and in stratum 2*b*, subjacent the producing stratum 2*a*. Said annular space is filled with a ring of insulating material 13 which penetrates into the formation 2*b*.

The housing of valve 30 is electrically insulated from the casing and the seal 31 is also an insulating liner. All the other parts shown in FIG. 2 are similar to the homologous part of FIG. 1.

As in the case of FIG. 1, electrode 9 is an anode which is connected to the positive terminal of a unidirectional source of voltage 22, the casing 3 being connected to the negative terminal of the source 22. The anode 9 and the lower end of the casing 3 situated above the insulating ring 13 are situated at a distance of at least 40 meters, but which can reach several hundred meters. The direct voltage delivered by the source 22 can vary between 200 and 10,000 V. The resistance equivalent to the formation volume situated between the two electrodes is around a few ohms and the current strength is between a few hundred and a few thousand amperes.

Figure 3:
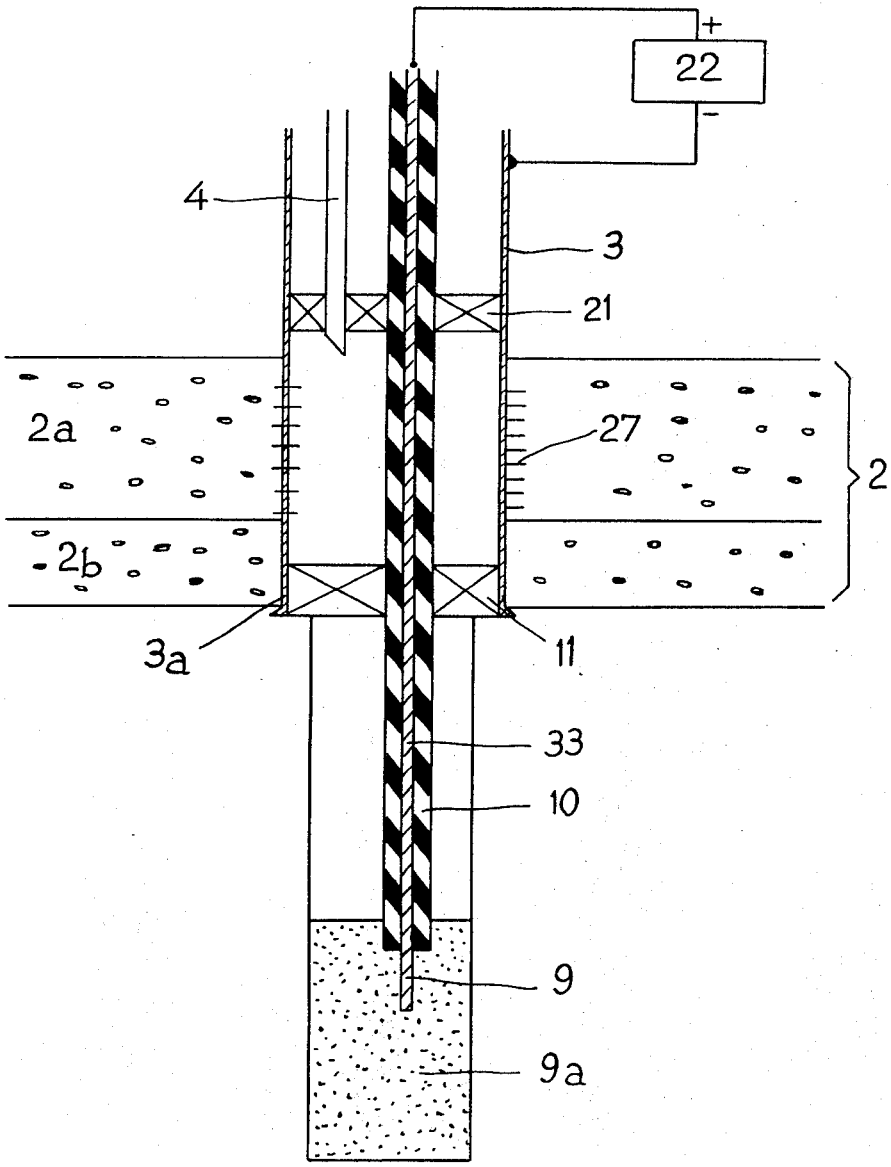

FIG. 3 is a vertical section of another example of application of the method according to the invention. This example shows a producing well with two columns, one production column 4 and one electrode column comprising a conductor 33 surrounded by an insulating sleeve 10.

The metallic casing 3 goes through the reservoir formation 2 and comprises perforations 27 right through said formation.

The well is drilled under the shoe 3*a* of the casing over a height of 40 meters and more, depending on the applications.

In the illustrated example, the anode 9 can be moved by raising or lowering the electrical column, whilst the method is being performed, thus altering the distance between the electrodes. The drilling beneath the shoe will at the beginning, make allowances for the lowest position of the electrode.

Figure 4:
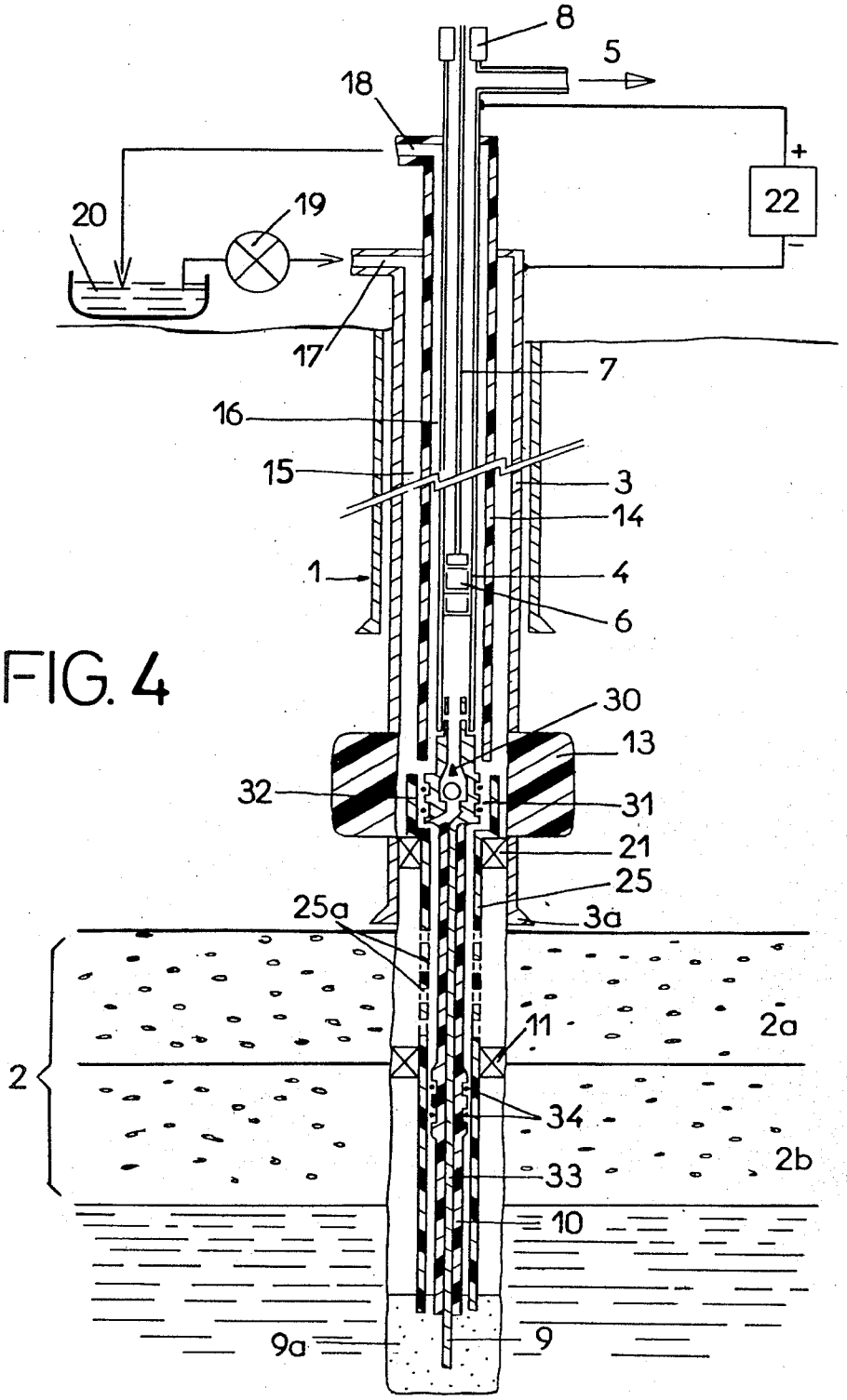

FIG. 4 illustrates a similar assembly to that shown in FIG. 1, the only difference being that the metallic casing 3 comprises an insulating sleeve 13 designed to electrically-insulate the lower part of the casing from the upper part.

Since the casing of the production wells is already fitted in and is normally constituted of metallic tubes, said casing is cut through over a height of several meters by an annular space which is situated at a distance of about one or more scores of meters above the roof of the formation.

After drilling said annular space, said space is filled with a ring 13 of insulating material, for example a polymerizable resin which penetrates into the enveloping strata. This solution enables to move the lower end of the cathode above the insulating ring 13, i.e. at several scores of meters above the roof of the reservoir formation.

Another solution, if the well is not already equipped with a metallic casing, consists in fitting in such a casing, which will comprise at its lower part, an insulating portion of several scores of meters, for example a portion in glassfiber-reinforced resin.

Figure 5:
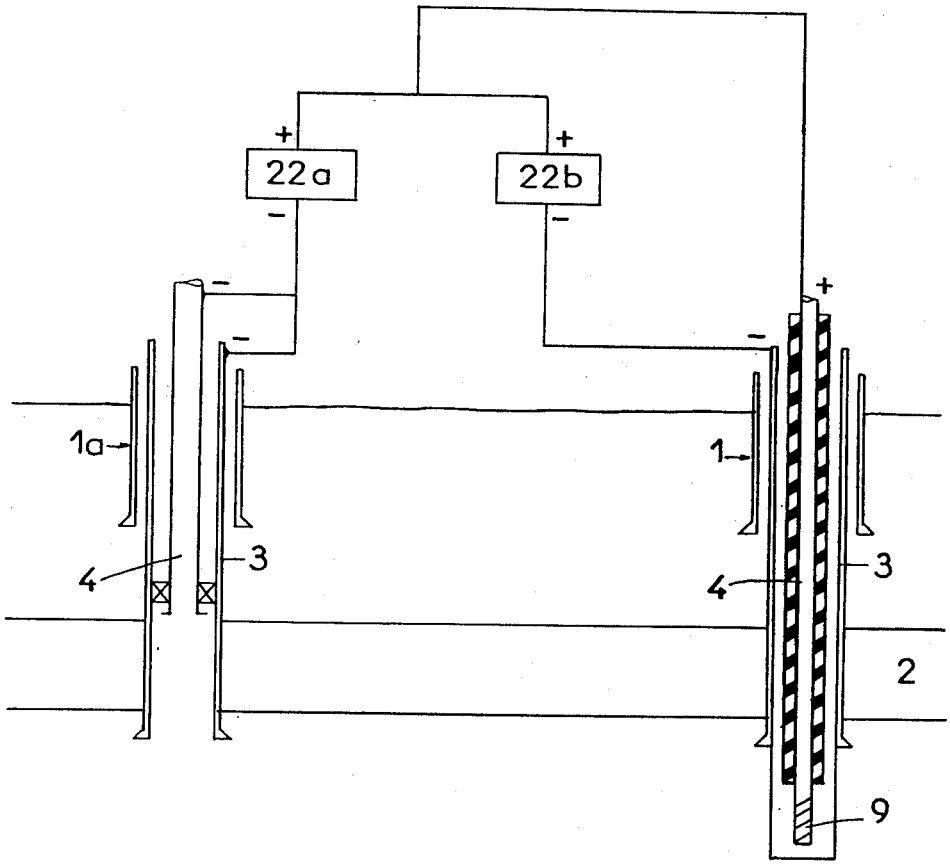
FIG. 5 is a vertical section showing one embodiment of the method according to the invention using two wells.

FIG. 5 illustrates another example of application of the method according to the invention, wherein two electrodes are horizontally spaced apart by being placed in two wells 1 and 1*a*. Well 1 and 1*a* can be producing wells, for example equipped with a perforated casing 3 traversing the reservoir formation 2 and a production tubing 4.

In the illustrated example, two direct voltage sources 22*a*, are used, which deliver two different or equal unidirectional voltages.

The tubing 4 and the casing 3 of one of the wells, for example well 1*a*, are connected in parallel on the negative terminal of a source of direct voltage 22*a*.

The tubing 4 of the other well is provided at its lower end with an elecrode 9, and is connected to the positive terminals of two sources 22*a*, 22*b*.

The well 1 is mounted in exactly the same way as described in FIGS. 1, 2, 3.

In this application, the casing 3 of the well 1 is also connected to the negative terminal of the source 22*b* as illustrated in FIG. 5, but this connection could be done away with, as well as the source 22*b*.

To improve the recovery of the oil contained in a formation 2, it is possible to use one or more well as cathode and one or more wells as anode. This technique lends itself to a production by scavenging using a pressurized fluid, or by pumping, wherein the electrode placed in each well can be constituted by the casing, the tubing or by an electrode suspended from a cable.

This last solution is an extension of the devices according to FIGS. 1, 2 or 3, wherein the negative terminal of the source 22*b* is connected not only to the casing of a first well containing the anode but also to the casing of several other producing wells surrounding the first well, so that oil recovery is improved in all the wells. All the wells, containing either the anode or the cathode, can be producing wells and the water-injecting wells used for the hydraulic scavenging are separate from the wells used for injecting the current.

The examples just described have the following characteristics in common.

The cathode is constituted by the upper part of the conductive metallic casing which is the casing normally provided in the well.

The anode is a very long anode, situated preferably beneath the reservoir formation, this Possibly necessitating a further deepening of a well. The position of said anode can, in certain cases, be altered, whilst the method is being performed, in order to vary the distance between the electrodes, this permitting to vary the formation volume subjected to a predetermined electric field and to vary the electric field. The voltage between the electrodes can be caused to vary as said electrodes are moved.

In the case where two electrodes are in the same wells, the distance separating the anode from the lower end of the cathode is at least 40 meters and can reach several hundred meters so that the lines of force of the electric field, enclose a large formation volume.

According to a variant, the rod 33 which electrically connects the body of the valve 30 to anode 9 can be replaced by a metal chain hanging from the valve body and hanging down towards the bottom of the well. The length of this chain is greater than the height separating the valve body from the bottom of the well, so that part of the chain is coiled at the bottom of the well and replaces the electro-conductive medium 9*a*. This solution enables to replace easily the chain or any part thereof worn through corrosion. The chain is contained inside a sleeve or insulating sheath 10 except for the part which acts as electrode.

The rod 33 can also be replaced by a conducting cable.

What is claimed is:

1. Electrical device for promoting the recovery of oil contained in a reservoir formation from a production well which is completed with a metallic casing extending at least as far as the roof of said reservoir formation and with a metallic production tubing which is electrically insulated from said casing, which device comprises:

a vertical extension of said well below said formation;

an electro-conductive medium placed in said vertical extension;

a source of unidirectional voltage situated on the surface;

an electrode electrically connected to the lower end of said production tubing, the lower end of said production tubing being equipped with a non-return valve and the upper end of said electrode being electrically connected to the body of said non-return valve, said electrode being situated in said vertical extension and being covered with an insulating sheath except over several meters at the lower end contacting said electro-conductive medium;

means electrically connecting the positive terminal of said source of unidirectional voltage to the upper end of said tubing and the negative terminal of said source to the upper end of said casing and means permitting to apply the unidirectional voltage supplied by said source, in direct or pulsed manner, for predetermined periods of several days to several months alternating with off periods of several days to several months.

2. Electrical device for promoting the recovery of oil contained in a reservoir formation from a production well which is completed with a metallic casing extending at least as far as the roof of said reservoir formation and with a metallic production tubing which is electrically insulated from said casing, which device comprises:

a vertical extension of said well below said formation;

an electro-conductive medium placed in said vertical extension;

a source of unidirectional voltage situated on the surface;

an electrode electrically connected to the lower end of said production tubing, said electrode being situated in said vertical extension and being covered with an insulating sheath except over several meters at the lower end contacting said electro-conductive medium;

means electrically connecting the positive terminal of said source of unidirectional voltage to the upper end of said tubing and the negative terminal of said source to the upper end of said casing and means permitting to apply the unidirectional voltage supplied by said source, in direct or pulsed manner, for predetermined periods of several days to several months, alternating with off periods of several days to several months, said electrode being a conductive rod which is placed vertically in said extension and which is covered with an insulating sheath except over some meters at the lower end which contact said electro-conductive medium and the upper end of said rod being secured and electrically connected to the lower end of said production tubing.

3. Electrical device for promoting the recovery of oil contained in a reservoir formation from at least two production wells remote from one another, each of which is equipped with a metallic casing and with a metallic production tubing, which device comprises:

a vertical extension of one of said wells below said formation;

an electro-conductive medium placed in said vertical extension;

two sources of unidirectional voltage situated on the surface;

an electrode placed in said vertical extension, which contacts said electro-conductive medium and which is connected in parallel to the positive terminals of said sources by connecting means insulated from said formation and from the casing of said one of said wells;

means connecting the negative terminals of said sources respectively to said casing of said one of said wells and, in parallel, to said casing and to said tubing of said at least one other well;

means permitting to apply the unidirectional voltages supplied by said sources, in direct or pulsed manner, for predetermined periods of several days to several months alternating with OFF-periods of several days to several months.

* * * * *